US011520271B2

(12) United States Patent
Furuya et al.

(10) Patent No.: US 11,520,271 B2
(45) Date of Patent: Dec. 6, 2022

(54) GLOSS TREATMENT DEVICE AND IMAGING DEVICE

(71) Applicant: HEWLETT-PACKARD DEVELOPMENT COMPANY, L.P., Spring, TX (US)

(72) Inventors: Satoru Furuya, Yokohama (JP); Keiji Komoto, Yokohama (JP); Yasuo Suzuki, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/484,291

(22) Filed: Sep. 24, 2021

(65) Prior Publication Data

US 2022/0113668 A1 Apr. 14, 2022

(30) Foreign Application Priority Data

Oct. 12, 2020 (JP) ..... JP2020-171734

(51) Int. Cl.
*G03G 15/20* (2006.01)
*G03G 15/00* (2006.01)

(52) U.S. Cl.
CPC ..... *G03G 15/6585* (2013.01); *G03G 15/2039* (2013.01); *G03G 15/2064* (2013.01); *G03G 2215/2032* (2013.01)

(58) Field of Classification Search
CPC ..... G03G 15/2039; G03G 15/2064; G03G 2215/2032; G03G 15/6585
See application file for complete search history.

(56) References Cited

U.S. PATENT DOCUMENTS

| | | | | |
|---|---|---|---|---|
| 2006/0263113 | A1* | 11/2006 | Matsumoto | G03G 15/6564 399/164 |
| 2014/0086644 | A1* | 3/2014 | Yasuda | G03G 15/2028 399/322 |
| 2016/0223959 | A1* | 8/2016 | Uekawa | G03G 15/2039 |
| 2016/0334749 | A1* | 11/2016 | Iwasaki | G03G 15/6573 |
| 2017/0212454 | A1* | 7/2017 | Miyamoto | G03G 15/1695 |
| 2018/0173152 | A1* | 6/2018 | Nakajima | G03G 15/0283 |
| 2018/0239280 | A1* | 8/2018 | Takagi | G03G 15/0291 |
| 2018/0275558 | A1* | 9/2018 | Kondo | G03G 15/2028 |
| 2022/0121147 | A1* | 4/2022 | Izawa | G03G 15/5029 |

FOREIGN PATENT DOCUMENTS

| | | | | |
|---|---|---|---|---|
| JP | 2003-5489 | | 1/2003 | |
| JP | 2004-325934 | | 11/2004 | |
| JP | 2005-107419 | | 4/2005 | |
| JP | 2010-128221 | | 6/2010 | |
| KR | 10-2008-0082864 | | 9/2008 | |
| WO | WO-2021007298 | A1 * | 1/2021 | G03G 15/0194 |

* cited by examiner

*Primary Examiner* — Sevan A Aydin
(74) *Attorney, Agent, or Firm* — Staas & Halsey LLP

(57) ABSTRACT

A gloss treatment device includes an endless belt to convey a print medium in a conveyance direction, a heating roller to heat the print medium, a pressing roller to press the print medium and the endless belt against the heating roller at a nip position, and a charging device located upstream the nip position in the conveyance direction, to charge the print medium with an electrostatic charge.

8 Claims, 11 Drawing Sheets

GLOSS TREATMENT DEVICE AND IMAGING DEVICE

CROSS REFERENCE TO RELATED APPLICATIONS

This application claims priority from Japanese Patent Application No. 2020-171734 filed on Oct. 12, 2020, the contents of which are incorporated herein by reference.

BACKGROUND

An imaging system may include, for example, a conveyance device which conveys paper, an image carrier on which an electrostatic latent image is formed, a developing device which develops the electrostatic latent image into a toner image, a transfer device which transfers the toner image to the paper, a fixing device which fixes the toner image to the paper, a gloss treatment device which performs a gloss treatment process on the toner image, and a discharging device which discharges the paper.

DETAILED DESCRIPTION

An example imaging system may include a gloss treatment device. The gloss treatment device may receive a paper on which a toner image has been melted and fixed (by a fixing device). The example gloss treatment device includes a heating roller, a pressing roller, and an endless belt that is engaged into rotation with the heating roller to perform a gloss treatment process on the toner image by which the heating roller and the pressing roller heat and remelt the toner image and a flat surface of the endless belt is reproduced onto the surface of the toner image to form a smooth surface of the toner image.

There may be an occurrence in which part of the toner is peeled off from the toner image during the gloss treatment process and adheres to the endless belt to remain. Such an occurrence in which part of the toner remains on the endless belt in this way may be referred to as a "toner offset". When the toner remains on the endless belt, a sheet of paper may be soiled during the next gloss treatment process.

According to examples of the gloss treatment device of the imaging system includes a charging device which charges the paper by an electrostatic charge. Accordingly, the paper and the endless belt can be electrostatically adsorbed, so as to suppress the occurrence of any toner offset.

Hereinafter, an example imaging system will be described with reference to the drawings. The imaging system may be an imaging device or apparatus such as a printer, or may be a device used in the imaging device or the like. In the following description, with reference to the drawings, the same reference numbers are assigned to the same components or to similar components having the same function, and overlapping description is omitted. In the present disclosure, the term "to" in a numerical range, indicates a range including the numerical values before and after "to" as the minimum value and the maximum value, respectively. Any value indicated by "approximately" includes the value and indicates a range including the vicinity of the value. The value indicated by "approximately" may be, in some examples, the value itself in which "approximately" is deleted.

Figure 1:
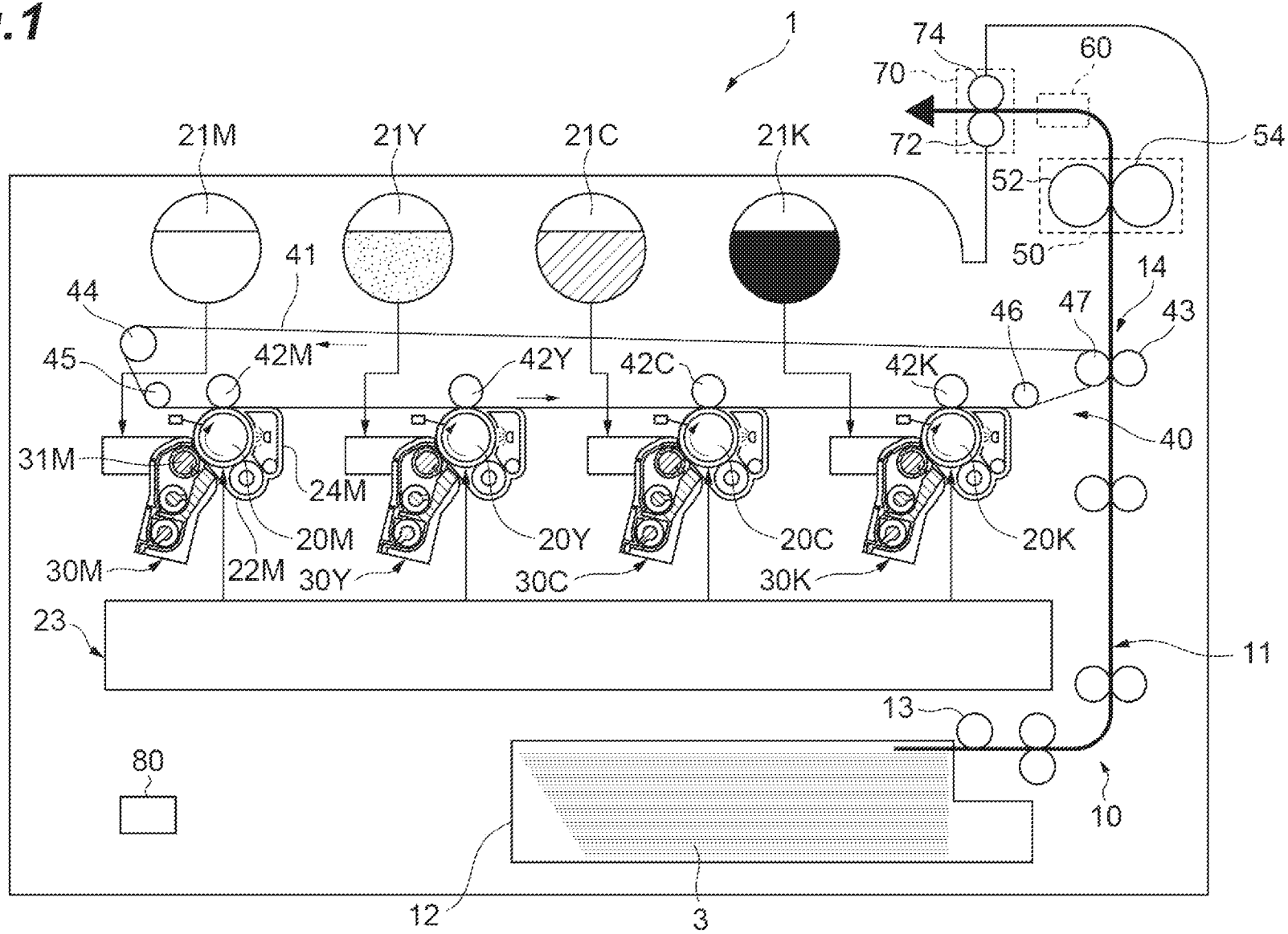
FIG. 1 is a schematic diagram of an example imaging device.

With reference to FIG. 1, an example of an imaging device (or an imaging apparatus) will be described. The example imaging device (or apparatus) 1 forms a color image by using four colors of magenta, yellow, cyan, and black, respectively represented in the numerical references by the characters "M", "Y", "C" and "K". The imaging device 1 includes a conveyance device 10 which conveys paper 3, such as a sheet of paper, corresponding to a print medium (or recording medium), image carriers 20M, 20Y, 20C, and 20K having respective surfaces (circumferential surfaces) on which respective electrostatic latent images are to be formed, developing devices 30M, 30Y, 30C, and 30K which develop the electrostatic latent images to form toner images, a transfer device 40 which forms a composite toner image and transfers the composite toner image to the paper 3, a fixing device 50 which fixes the toner image to the paper 3, a gloss treatment device 60 which performs a gloss treatment process on the toner image on the paper 3, a discharging device 70 which discharges the paper 3, and a controller 80.

The conveyance device 10 conveys the paper 3 corresponding to a recording medium on which an image is to be formed, along a conveyance path 11. The paper 3 is initially accommodated in a cassette 12 in a stacked state, and is picked up by a paper feeding roller 13 to be conveyed to the conveyance path 11.

Each of the image carriers 20M, 20Y, 20C, and 20K may also be referred to as an electrostatic latent image carrier, a photoreceptor drum, or the like. The image carrier 20M forms an electrostatic latent image for forming a magenta toner image. The image carrier 20Y forms an electrostatic latent image for forming a yellow toner image. The image carrier 20C forms an electrostatic latent image for forming a cyan toner image. The image carrier 20K forms an electrostatic latent image for forming a black toner image. The image carriers 20M, 20Y, 20C, and 20K have substantially the same configuration. Accordingly, the image carrier 20M will be described as a representative image carrier among the image carriers 20M, 20Y, 20C, and 20K.

The developing device 30M, a charging roller 22M, an exposure unit (or exposure device) 23, and a cleaning unit (or cleaning device) 24M are provided on adjacent the image carrier 20M. Similarly, the developing devices 30Y, 30C, and 30K, respective charging rollers, the exposure unit 23, and respective cleaning units (or devices) are also provided adjacent the image carriers 20Y, 20C, and 20K.

The charging roller 22M is a charging device that charges the surface of the image carrier 20M to a predetermined potential. The charging roller 22M rotates in a following manner in accordance with the rotation of the image carrier 20M. The exposure unit 23 exposes the surface of the image carrier 20M having been charged by the charging roller 22M, in accordance with the image to be formed on the paper 3. Accordingly, a potential of a portion exposed by the exposure unit 23 in the surface of the image carrier 20M changes so that the electrostatic latent image is formed. The cleaning unit 24M collects toner remaining on the image carrier 20M.

The developing device 30M forms a magenta toner image by developing the electrostatic latent image formed on the image carrier 20M using a toner supplied from a toner tank 21M that contains a magenta toner and a carrier. The developing device 30Y forms a yellow toner image by developing the electrostatic latent image formed on the image carrier 20Y using a toner supplied from a toner tank 21Y that contains a yellow toner and a carrier. The developing device 30C forms a cyan toner image by developing the electrostatic latent image formed on the image carrier 20C using a toner supplied from a toner tank 21C that contains a cyan toner and a carrier. The developing device 30K forms a black toner image by developing the electrostatic latent image formed on the image carrier 203E using a toner supplied from a toner tank 21K that contains a black toner and a carrier. The developing devices 30M, 30Y, 30C, and 30K have substantially the same configuration. Accordingly, the developing device 30M will be described as a representative developing device among the developing devices 30M, 30Y, 30C, and 30K.

The developing device 30M includes a developing roller 31M which transfers a toner to the image carrier 20M. In the developing device 30M, a two-component developer containing a toner and a carrier is used as a developer. Namely, in the developing device 30M, the toner and the carrier are adjusted to have a targeted mixing ratio and are further mixed and stirred to disperse the toner so that the developer is adjusted to have a targeted charging amount. In the developing device 30M, this developer is carried on the developing roller 31M. Then, when the developer is conveyed to a region facing the image carrier 20M by the rotation of the developing roller 31M, the toner in the developer carried on the developing roller 31M transfers to the electrostatic latent image formed on the circumferential surface of the image carrier 20M so that the electrostatic latent image is developed, thereby forming a toner image.

The transfer device 40 conveys the toner images respectively formed on the developing devices 30M, 30Y, 30C, and 30K and transfers the toner images onto the paper 3. The transfer device 40 includes a transfer belt 41 to which the toner images is primarily transferred from the respective image carriers 20M, 20Y, 20C, and 20K, suspension rollers 44, 45, 46, and 47 which suspend (or support) the transfer belt 41, primary transfer rollers 42M, 42Y, 42C, and 42K which is positioned so that the transfer belt 41 extends between the primary transfer rollers 42M, 42Y, 42C, and 42K and the image carriers 20M, 20Y, 20C, and 20K so as to primarily transfer the toner images from the respective image carriers 20M, 20Y, 20C, and 20K to the transfer belt 41, and a secondary transfer roller 43 which is positioned so that the transfer belt 41 extends between the secondary transfer roller 43 and the suspension roller 47 so as to secondarily transfer a composite toner image (in which the respective toner images are layered) from the transfer belt 41 to the paper 3.

The transfer belt 41 is an endless belt which moves in a circulating manner by the suspension rollers 44, 45, 46, and 47 which are rotatable around respective rotational axes. The suspension roller 47 is a drive roller which is rotationally driven and the suspension rollers 44, 45, and 46 are driven rollers which rotate in a following manner by the rotational driving of the suspension roller 47. The primary transfer roller 42M is presses against the image carrier 20M from the inner circumference side of the transfer belt 41, The primary transfer roller 42Y is pressed against the image carrier 20Y from the inner circumference side of the transfer belt 41. The primary transfer roller 42C is pressed against the image carrier 20C from the inner circumference side of the transfer belt 41. The primary transfer roller 42K is pressed against the image carrier 20K from the inner circumference side of the transfer belt 41, The respective toner images that are primarily transferred, are sequentially layered on the transfer belt 41 so as to form the composite toner image. The secondary transfer roller 43 is disposed in parallel to the suspension roller 47 with the transfer belt 41 interposed therebetween and is provided to press against the suspension roller 47 from the outer circumference side of the transfer belt 41. Accordingly, the secondary transfer roller 43 forms a transfer nip position 14 between the secondary transfer roller 43 and the transfer belt 41, in order to transfer the composite toner image from the transfer belt 41 to the paper 3.

The fixing device 50 allows the paper 3 to pass through a fixing nip position where the paper is heated and pressed so that the composite toner image secondarily transferred from the transfer belt 41 to the paper 3 is attached and fixed to the paper 3. The fixing device 50 includes a heating roller 52 which heats the paper 3 and a pressing roller 54 which is rotationally driven while pressing the heating roller 52. The heating roller 52 and the pressing roller 54 are formed in a cylindrical shape and the heating roller 52 includes a heat source such as a halogen lamp, therein, A fixing nip position corresponds to a contact region between the heating roller 52 and the pressing roller 54, and the toner image is melted and fixed to the paper 3 when the paper 3 passes through the fixing nip position.

The gloss treatment device 60 performs a gloss treatment process on the toner image that is fixed to the paper 3, as will be described further below. The discharging device 70 includes discharge rollers 72 and 74 which discharge the paper 3 to the outside of the imaging device 1.

The controller 80 may be provided by an electronic control unit (or electronic control device) which includes a Central Processing Unit (CPU), a Read Only Memory (ROM), a Random Access Memory (RAM), and the like. In the controller 80, a program stored in the ROM is loaded to the RAM and is executed by the CPU to perform various controls. The controller 80 may be configured as a plurality of electronic control units or a single electronic control unit. The controller 80 controls the various components in the imaging device 1.

Figure 2:
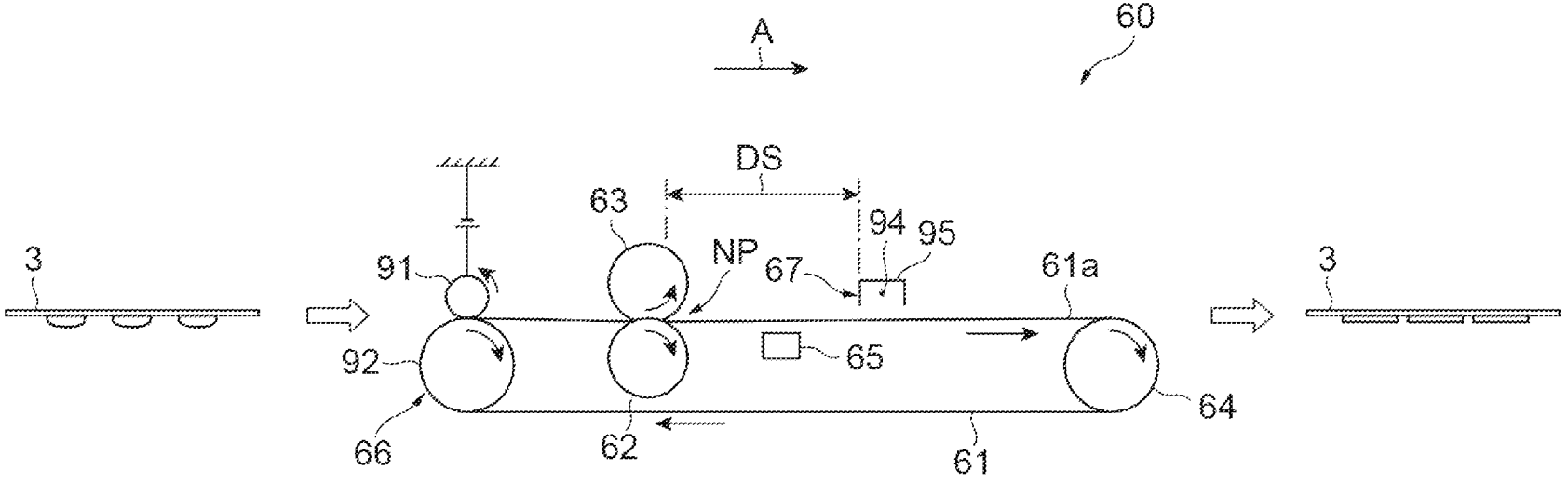
FIG. 2 is a schematic diagram of an example gloss treatment device.

With reference to FIG. 2, an example of the gloss treatment device 60 includes an endless belt 61, a heating roller 62, a pressing roller 63, a tension roller 64, a cooling unit (or cooling device) 65, a charging device 66, and a discharging device 67. The charging device 66 includes a charging roller 91 and a grounding roller 92.

The endless belt 61 extends around the tension roller 64 and the grounding roller 92. The endless belt 61 is driven by the rotation of the tension roller 64 and the grounding roller 92 and conveys the paper 3 disposed on the surface, in a conveyance direction A. The endless belt 61 includes a flat contact surface 61*a* on the outer circumference. The endless belt 61 is also referred to as a smoothness imparting belt and imparts smoothness to the toner image on the paper 3 by contacting the toner image on the contact surface 61*a*. The contact surface 61*a* has surface free energy of approximately 5 $mJ/m^2$ or more. The surface free energy of the contact surface 61*a* can be adjusted by changing the material of the endless belt 61. Examples of the material forming a base material of the endless belt 61 may include polyimide, polyamideimide, polyetheretherketone, polyphenylene sulfide, polycarbonate, or the like. The surface free energy of the contact surface 61*a* can also be adjusted by applying a hydrophobic coating to the contact surface 61*a*, The surface free energy of the contact surface 61*a* can also be adjusted by applying a coating containing fluorine or silicon atoms to the contact surface 61*a*, or the like. The surface free energy can be measured, for example, by a wettability test using a portable contact angle meter PCA-11 manufactured by Kyowa Interface Science Co., Ltd. or the like.

The heating roller 62, the pressing roller 63, the tension roller 64, the charging roller 91, and the grounding roller 92 are rotatable around their respective rotational axes. The pressing roller 63 is a drive roller which is rotationally driven, and the heating roller 62, the tension roller 64, the charging roller 91, and the grounding roller 92 are driven rollers which are rotationally driven by the rotation of the pressing roller 63.

The heating roller 62 may include, for example, a heat source therein so as to adjust a temperature. The pressing roller 63 has an elastic outer circumferential surface and presses the paper 3 and the endless belt 61 between the outer circumferential surface and the heating roller 62. A nip position NP is formed between the heating roller 62 and the pressing roller 63. At the nip position NP, the toner image on the paper 3 is remelted by being heated while being pressed by the heating roller 62 and the pressing roller 63. In a gloss treatment process, the contact surface 61*a* of the endless belt 61 is transferred to (e.g., reproduced on) the melted toner image.

The tension roller 64 is disposed downstream the nip position NP in the conveyance direction A and is engaged into rotation with the endless belt 61. The cooling device 65 cools the toner on the paper 3. According to examples, the cooling device 65 is disposed inside the endless belt 61 to cool the toner on the paper 3 by blowing cold air toward the endless belt 61.

Figure 3:
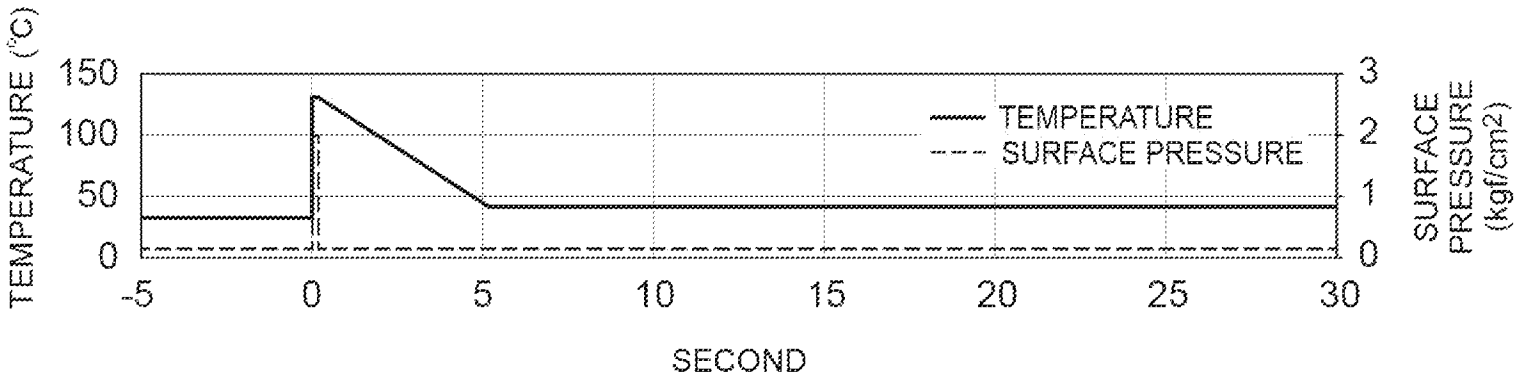
FIG. 3 is a graph showing a change in temperature of a paper and a surface pressure applied to the paper during an example gloss treatment process.

In FIG. 3, a graph illustrates a temperature of a paper and a surface pressure applied to the paper, over time, in an example gloss treatment process. In the horizontal axis, a time of 0 seconds indicates a time point at which the paper 3 is nipped by the heating roller 62 and the pressing roller 63 at the nip position NP. As shown in the graph, a surface pressure applied to the paper 3 is approximately 2 $kgf/cm^2$ at the nip position NP, and decreases to approximately 0 thereafter. The temperature of the paper 3 reaches approximately 120 to 130° C. at the nip position NP and then decreases to be 50° C. or less for 5 seconds.

The charging device 66 is disposed upstream the nip position NP in the conveyance direction A and charges the paper 3 by electrostatic charge (static charge). The paper 3 to which the toner image has been fixed by the fixing device 50, is supplied to the charging device 66. When the paper 3 is charged, the paper 3 and the endless belt 61 can be electrostatically adsorbed.

As described above, the charging device 66 includes the charging roller 91 and the grounding roller 92. The paper 3 and the endless belt 61 are pressed between the charging roller 91 and the grounding roller 92. The charging roller 91 is electrically connected to a power supply to be charged, so as to charge the paper 3 by the electrostatic charge. The grounding roller 92 is grounded. The grounding roller 92 also functions as a tension roller that applies a tension to the endless belt 61.

The discharging device 67 is disposed downstream the nip position NP in the conveyance direction A to eliminate the electrostatic charge from the paper 3. When the electrostatic charge is eliminated from the paper 3, the paper 3 can be peeled off from the endless belt 61. A distance DS from the nip position NP to the discharging device 67 is approximately 10 cm or more. The distance DS is a distance from a downstream end of the nip position NP to the discharging device 67, in the conveyance direction A. The discharging device 67 includes a wire electrode 94 to which an AC voltage is applied and a casing 95 which covers the wire electrode 94 in a grounded state. The configuration of the discharging device 67 is not limited to this example and can be modified to adopt any suitable configuration.

Figure 4:
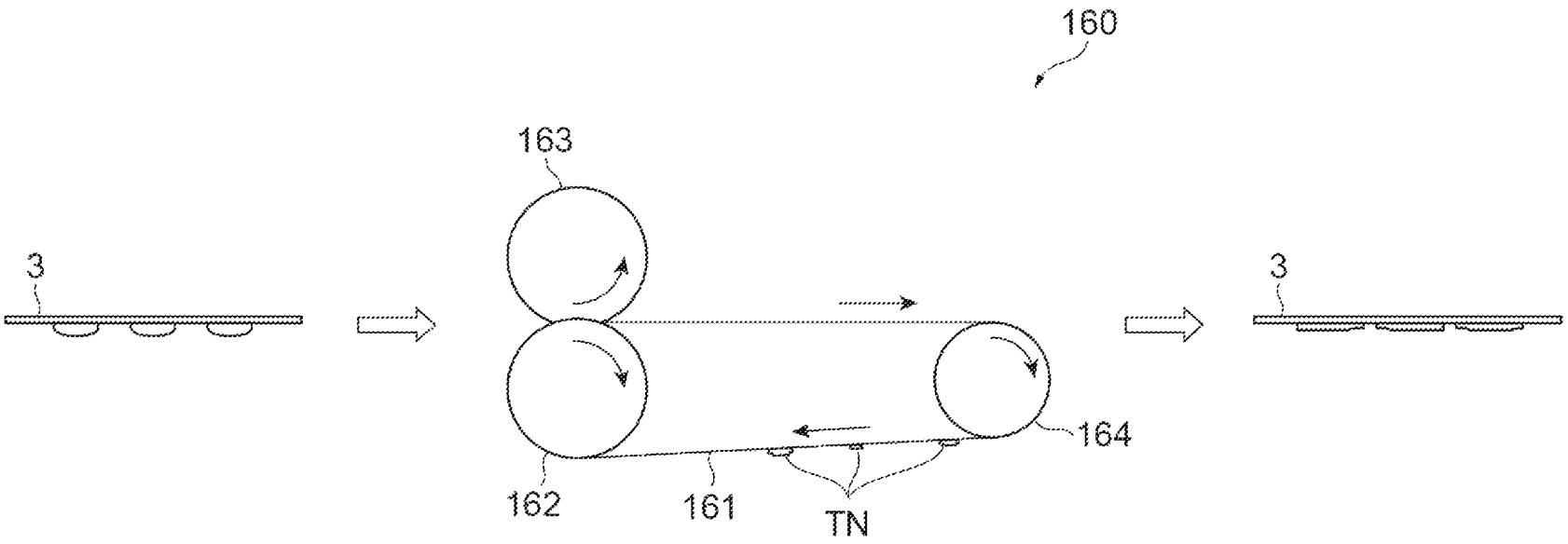
FIG. 4 is a schematic diagram of another example gloss treatment device.
Figure 5:
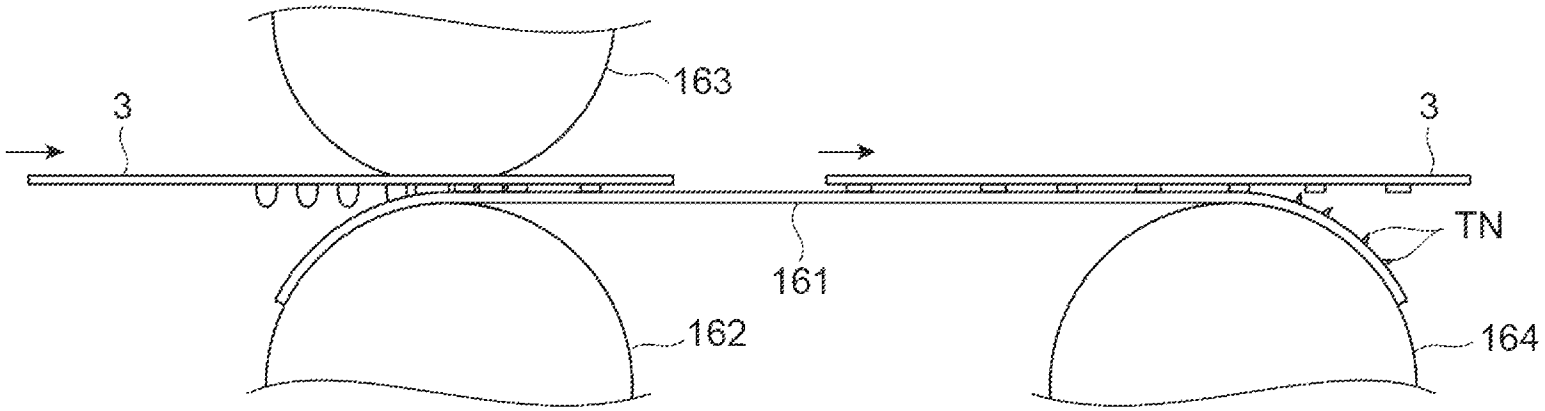
FIG. 5 is a schematic diagram illustrating a portion of the gloss treatment device of FIG. 4.

Referring to FIGS. 4 and 5, an example gloss treatment device 160 includes an endless belt 161, a heating roller 162, a pressing roller 163, and a tension roller 164. The gloss treatment device 160 mainly differs from the gloss treatment device 60 in that the charging device 66 and the discharging device 67 are not provided.

In the gloss treatment device 160, a part of the toner may be peeled off from the toner image during the gloss treatment process and a toner offset may occur in which the peeled toner is transferred and attached (or adhered) to the endless belt 161 as residual toner TN that remains on the endless belt 161. The residual toner TN that remains on the endless belt 161, may soil a sheet of paper that is conveyed on the endless belt 161 during a subsequent gloss treatment process.

The toner offset is more likely to occur in an image containing halftone dots or fine lines (Screen pattern) than in a large area image (Solid image). It is considered that this due to the latter having a physical shape in which the force of attraction between the toners tends to be weak and the force of attraction due to the surface free energy of the endless belt 161 tends to be greater than the force of attraction on the toner side.

Figure 6:
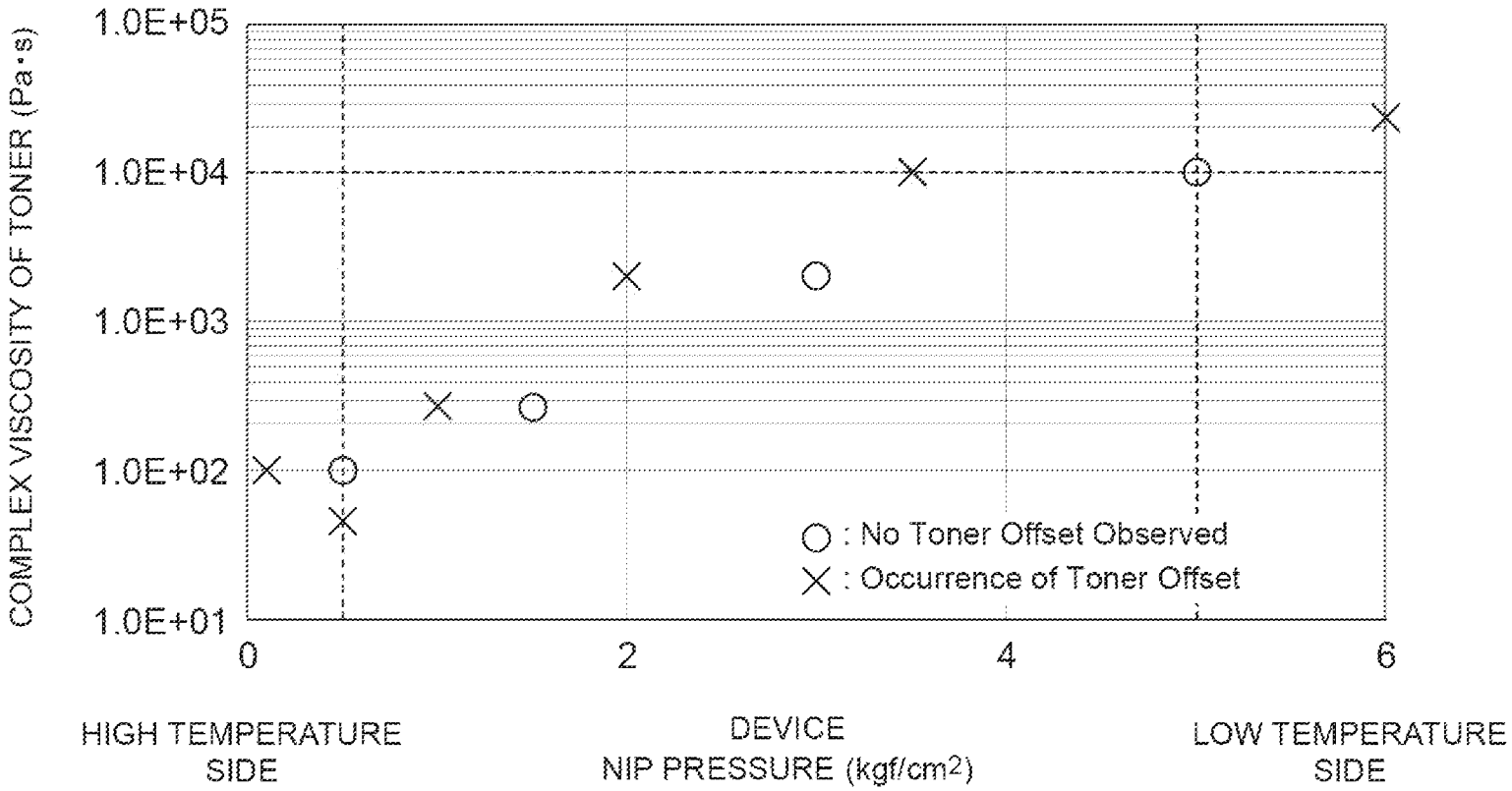
FIG. 6 is a graph illustrating conditions for obtaining a high-gloss image in the gloss treatment device of FIG. 4.
Figure 7:
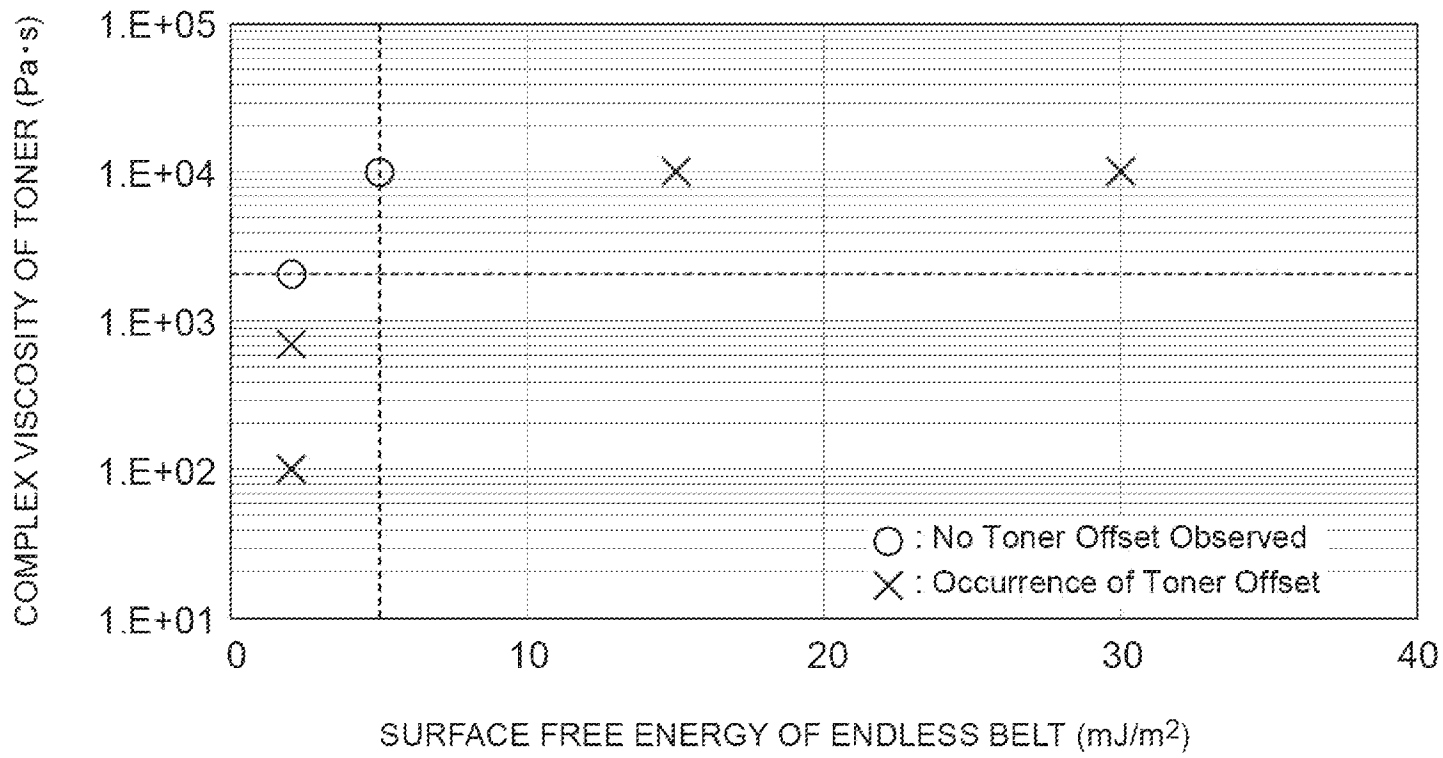
FIG. 7 is a graph illustrating conditions for preventing a toner offset in the gloss treatment device of FIG. 4.
Figure 8:
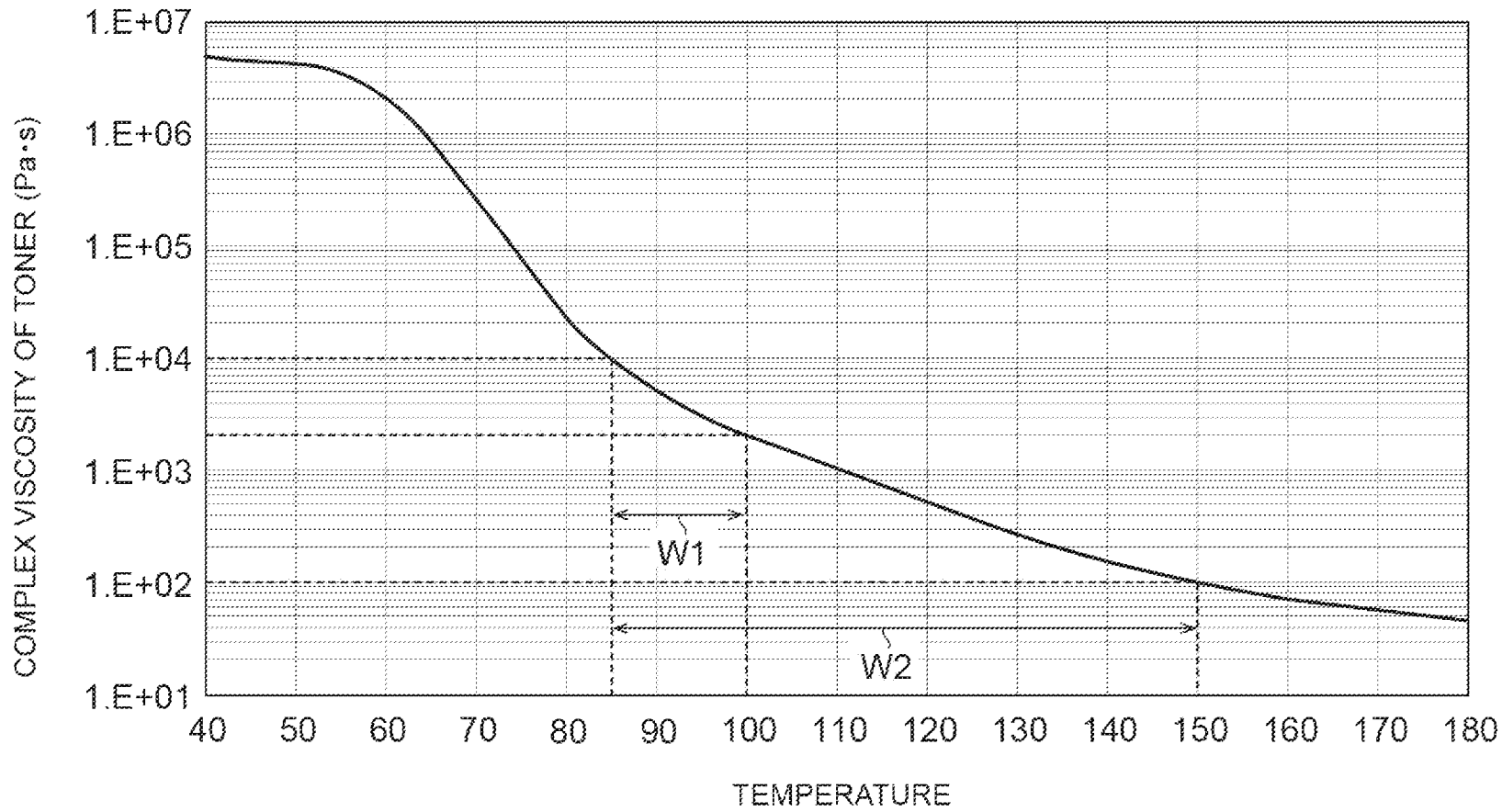
FIG. 8 is a graph of a complex viscosity of a toner relative to a temperature of the toner.
Figure 9:
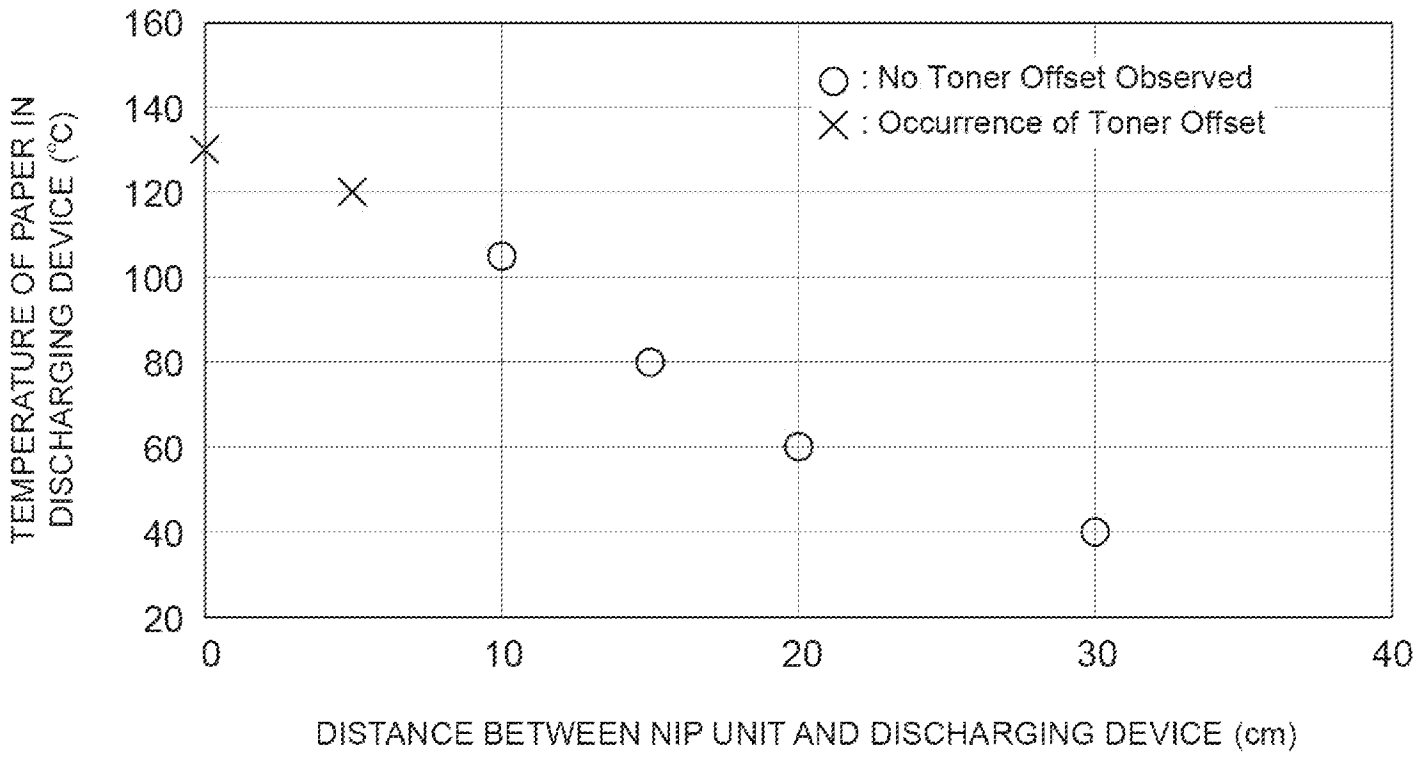
FIG. 9 is a graph illustrating experimental results of a temperature of a paper at a discharging device in example gloss treatment devices having various distances between a nip position and the discharging device.
Figure 11:
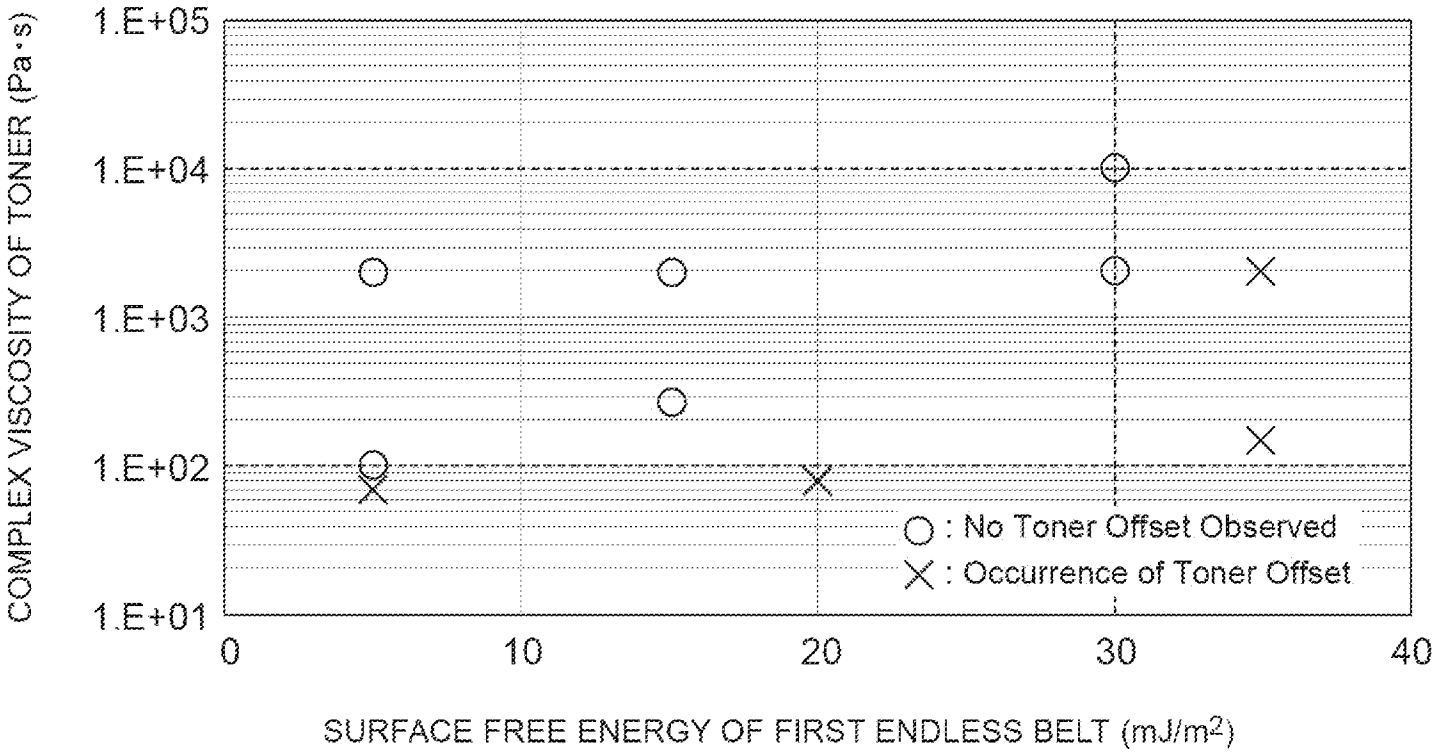
FIG. 11 is a graph illustrating conditions for preventing a toner offset in the example gloss treatment device of FIG. 10.

The likelihood of the toner offset also varies depending on the roughness of the paper. The inventors have experimentally confirmed that the toner offset tends to occur more easily as the roughness of the paper increases. It is considered that this is because the toner is not sufficiently pressed due to the toner entering the recess and the adhesion of the toner to the fibers weakens as the roughness increases, FIG. 6 is a graph showing conditions for obtaining a high-gloss image in the example gloss treatment device 160 illustrated in FIGS. 4 and 5, having no charging device or discharging device. A nip pressure is a pressure which is applied to the paper 3 at the nip position NP by the heating roller 62 and the pressing roller 63. In FIG. 6, the symbol "○" indicates that the toner offset does not occur and the symbol "x" indicates that the toner offset occurs. This also applies in FIGS. 7, 9, and 11, FIG. 7 is a graph showing conditions for preventing the toner offset in the example gloss treatment device 160. FIG. 8 is a graph showing a relationship between the complex viscosity of the toner and the temperature of the toner. The complex viscosity of the toner can be measured, for example, by the melt viscoelasticity measuring device ARES-G2 manufactured by TA Instruments Japan Inc.

As shown in FIG. 7, in the case of the gloss treatment device 160, the surface free energy of the endless belt 161 is to be set to less than 5 $mJ/m^2$. Further, the complex viscosity of the toner should be controlled so as to be greater than $2\times10^3$ Pa·S in order to allow the force of attraction between the toners to be greater than the force of attraction of the endless belt 161. As shown in FIG. 8, the complex viscosity of the toner changes according to the temperature of the toner.

On the other hand, the complex viscosity of the toner should be less than $1\times10^4$ Pa·S in order to impart a suitable smoothness to the toner image using the endless belt 161, Thus, the complex viscosity of the toner should be controlled so as to be at $2\times10^3$ to $1\times10^4$ Pa·S in order to suppress the toner offset while allowing the gloss treatment process to be performed. In this case, as shown in FIG. 8, the temperature of the heating roller 62 during the gloss treatment process should be controlled to approximately 85° C. to 100° C. and a temperature control width (or temperature control range) W1 is as narrow as approximately 15° C. It is difficult to control the temperature in order to satisfy the temperature control width W1. Accordingly, it may be difficult to obtain a suitable image quality in a more stable manner.

In contrast, the example gloss treatment device 60 includes the charging device 66 which charges the paper 3 by the electrostatic charge. Accordingly, the paper 3 and the endless belt 61 can be electrostatically adsorbed, so as to suppress the occurrence of toner offset.

The following findings have been observed. As described above, the surface of the pressing roller 63 has elasticity and is compressed and deformed when the paper 3 and the endless belt 61 are pressed between the pressing roller 63 and the heating roller 62. When the paper 3 is conveyed from the nip position NP, a slight speed difference or a minute gap is generated between the toner image on the paper 3 and the endless belt 61 due to the influence of the movement of the pressing roller 63 when the pressing roller returns from a compressed shape to an original shape. At this time, it has been found that a part of the toner image in the state between melting and solidification may be torn, transferred to the endless belt 61, and adhered to remain on the endless belt 61. In contrast, when the paper 3 and the endless belt 61 are electrostatically adsorbed by using the charging device 66 as described above, the toner image may be inhibited from remaining on the endless belt 61.

Further, the gloss treatment device 60 includes the discharging device 67 which is disposed downstream the nip position NP in the conveyance direction A and eliminates the electrostatic charge from the paper 3. Accordingly, the paper 3 adsorbed by the electrostatic charge can be reliably peeled off from the endless belt 61 so as to more reliably suppress the occurrence of toner offset.

Further, the temperature of the paper 3 (the toner on the paper 3) in the discharging device 67 during the gloss treatment process is approximately 105° C. or less. Accordingly, the occurrence of the toner offset can be more reliably suppressed. This point will be described further with reference to FIG. 9. FIG. 9 is a graph illustrating experimental results when the distance DS between the nip position NP and the discharging device 67 is changed. In this experiment, the printing speed was set to 8 Page Per Minute (PPM), the nip pressure was set to 2 $kgf/cm^2$, the temperature (the system temperature) of the heating roller 62 was set to 130° C. (in other words, the complex viscosity of the toner was set to $2.66\times10^2$ Pa·S), and the surface free energy of the endless belt 61 was set to 12.2 $mJ/m^2$.

As shown in FIG. 9, when the distance DS between the nip position NP and the discharging device 67 is 10 cm or more, the temperature of the paper 3 in the discharging device 67 during the gloss treatment process becomes approximately 105° C. or less and the occurrence of the toner offset can be prevented. When the distance DS is less than 10 cm, it is considered that an offset occurs since the toner is separated from the endless belt 61 at a temperature greater than 105° C. When the distance DS is 10 cm or more, it is considered that the toner offset can be prevented since a minute gap is not generated between the paper 3 and the endless belt 61 when the toner is at a temperature greater than 105° C. and the toner is separated from the endless belt 61 at a temperature lower than 105° C. The distance DS to set the temperature of the paper 3 in the discharging device 67 to be approximately 105° C. or less, can be changed according to various conditions. For example, in the above-described example, when the printing speed is set to 4 PPM, which is a half of 8 PPM, it is expected that the temperature of the paper 3 drops to 105° C. at a position in which the distance DS is 5 cm.

Further, in the gloss treatment device 60, the charging device 66 includes the charging roller 91 and the grounding roller 92 which interpose the paper 3 and the endless belt 61 therebetween. Accordingly, the paper 3 can be satisfactorily charged.

Further, the gloss treatment device 60 includes the tension roller 64 which is disposed downstream the nip position NP, in the conveyance direction A and is engaged with the endless belt 61. Accordingly, a passage for the conveyance of the paper 3 can be formed between the nip position NP and the tension roller 64 and the electrostatic charge can be eliminated or the toner can be cooled on the downstream side of the nip position NP. Additionally, the tension roller 64 may be grounded so that the tension roller 64 has a function of eliminating the electrostatic charge or the tension roller 64 has a function of cooling the toner.

Further, in the gloss treatment device 60, the endless belt 61 has surface free energy of approximately 5 $mJ/m^2$ or more. In this way, in the gloss treatment device 60, the endless belt 61 having a surface free energy of approximately 5 $mJ/m^2$ or more can be used and the degree of freedom in design can be improved (e.g., increased a range of materials that may be selected).

Further, in the gloss treatment device 60, the temperature of the paper 3 (the toner on the paper 3) at the nip position NP during the gloss treatment process is approximately 85° C. to 150° C. Namely, in the gloss treatment device 60, as shown in FIG. 8, the complex viscosity of the toner may be $1\times10^2$ to $1\times10^4$ Pa·S and the temperature of the toner at the nip position NP during the gloss treatment process may be approximately 85° C. to 150° C. Accordingly, a temperature control width (or temperature control range) W2 is as wide as approximately 65° C. and suitable image quality can be obtained in a more stable manner. Namely, in the gloss treatment device 60, the temperature control width W2 is wider than approximately 15° C. and the temperature of the paper 3 at the nip position NP during the gloss treatment process can reach approximately 100° C. to 150° C. Namely, in the example gloss treatment device 160 without any charging device or discharging device, the temperature of the heating roller 162 is to be strictly controlled in order to keep the temperature of the toner within the temperature control width W1. In contrast, in the example gloss treatment device 60, since the temperature control width W2 is wide, the temperature of the heating roller 62 can be more easily controlled.

Further, the example imaging device 1 includes the gloss treatment device 60 and the fixing device 50 for fixing the toner image to the paper 3 and the paper 3 to which the toner image has been fixed, is supplied to the gloss treatment device 60. According to the imaging device 1, the occurrence of the toner offset can be suppressed due to the above-mentioned reason.

Figure 10:
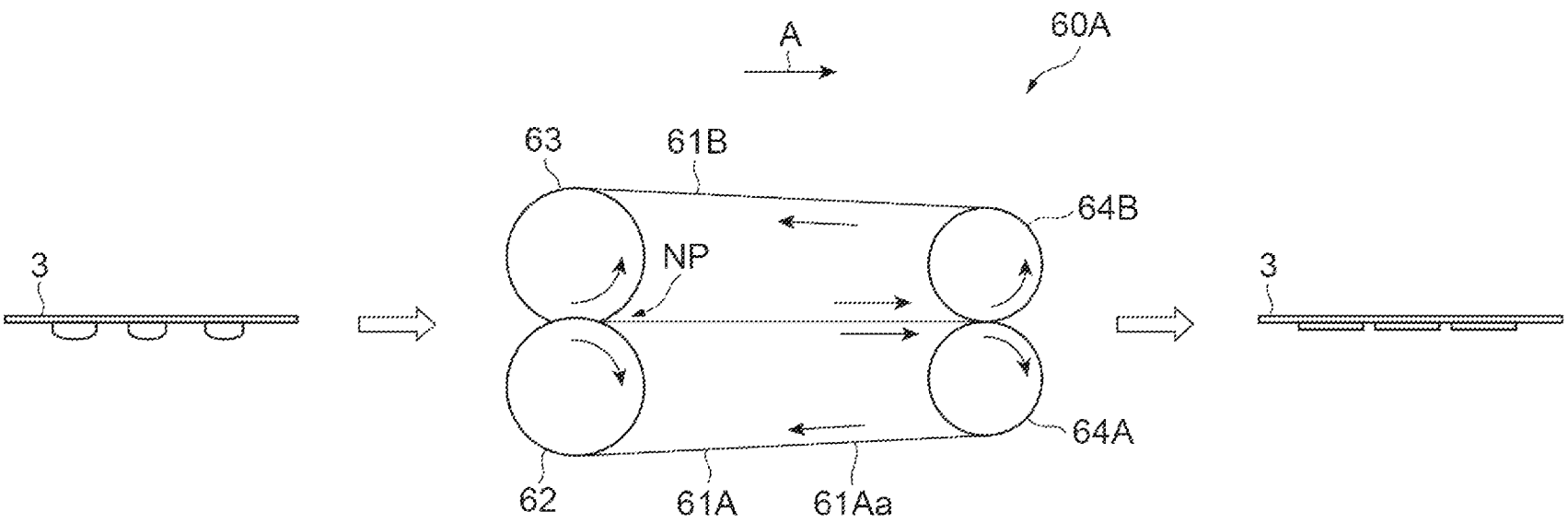
FIG. 10 is a schematic diagram illustrating another example gloss treatment device.

With reference to FIG. 10, a gloss treatment device 60A according to another example includes a first endless belt 61A, a second endless belt 61B, the heating roller 62, the pressing roller 63, a first tension roller 64A, and a second tension roller 64B. The first endless belt 61A, the heating roller 62, the pressing roller 63, and the first tension roller 64A respectively correspond to the endless belt 61, the heating roller 62, the pressing roller 63, and the tension roller 64.

The first endless belt 61A conveys the paper 3 in the conveyance direction A. The second endless belt 61B conveys the paper 3 while interposing the paper between the second endless belt 61B and the first endless belt 61A. The heating roller 62 is disposed inside the first endless belt 61A to rotationally engage with the first endless belt 61A. The pressing roller 63 is disposed inside the second endless belt 61B to rotationally engage with the second endless belt 61B. The pressing roller 63 presses the paper 3, the first endless belt 61A, and the second endless belt 61B between the pressing roller 63 and the heating roller 62 at the nip position NP. The first tension roller 64A is disposed downstream the nip position NP in the conveyance direction A and is rotationally engaged with the first endless belt 61A. The second tension roller 64B is disposed downstream the nip position NP in the conveyance direction A and is rotationally engaged with the second endless belt 61B.

The first endless belt 61A includes a flat contact surface 61Aa on the outer circumference. The contact surface 61Aa has surface free energy of approximately 5 $mJ/m^2$ or more and 30 $mJ/m^2$ or less.

The gloss treatment device 60A can also suppress the occurrence of the toner offset similarly to the gloss treatment device 60. For example, in the gloss treatment device 60A, the paper 3 is conveyed while being interposed between the first endless belt 61A and the second endless belt 61B. Therefore, the paper 3 can be brought into contact suitably with the first endless belt 61A so as to suppress the occurrence of toner offset. Further, the first endless belt 61A forms the contact surface 61Aa having a surface free energy of approximately 30 $mJ/m^2$ or less. This also can suppress the occurrence of the toner offset.

Additionally, the gloss treatment device 60A includes the first tension roller 64A which is disposed downstream the nip position NP in the conveyance direction A and which is rotationally engaged with the first endless belt 61A, so as to suitably convey the paper 3.

Further, the gloss treatment device 60A includes the second tension roller 64B which is disposed downstream the nip position NP in the conveyance direction A and which is rotationally engaged with the second endless belt 61B, in order to suitably convey the paper 3.

Additionally, in the gloss treatment device 60A, the temperature of the paper 3 (the toner on the paper 3) at the nip position NP during the gloss treatment process is approximately 85° C. to 150° C. Namely, also in the gloss treatment device 60A, as shown in FIG. 8, the complex viscosity of the toner may be $1\times10^2$ to $1\times10^4$ Pa·S and the temperature of the toner at the nip position NP during the gloss treatment process may be approximately 85° C. to 150° C. Thus, the temperature control width W2 is as wide as approximately 65° C. and suitable image quality can be obtained in a more stable manner. Namely, in the gloss treatment device 60A, the temperature control width W2 is wider than approximately 15° C. and the temperature of the paper 3 at the nip position NP during the gloss treatment process can reach approximately 100° C. to 150° C. Namely, in the gloss treatment device 160 without any charging or discharging device, the temperature of the heating roller 162 is to be controlled strictly, in order to keep the temperature of the toner within the temperature control width W1. In contrast, the temperature is more easily controlled in the gloss treatment device 60, since the temperature control width W2 is wider.

Further, in the gloss treatment device 60A, the heating roller 62 and the pressing roller 63 apply a pressure of approximately 0.5 $gf/cm^2$ to 5.0 $kgf/cm^2$ to the paper 3 at the nip position NP. As shown in FIG. 6, the gloss treatment process can be performed more suitably by setting the nip pressure within the above-described range.

Further, in the gloss treatment device 60A, the contact surface 61Aa has surface free energy of approximately 5 $mJ/m^2$ or more. Accordingly, in the gloss treatment device 60A, the first endless belt 61A having a surface free energy of approximately 5 $mJ/m^2$ or more can be used so as to increase the degree of freedom in design (e.g., a range of materials that may be selected), FIG. 11 is a graph showing conditions for preventing the toner offset in the gloss treatment device 60A. In the experimentation associated with FIG. 11, the printing speed was set to 8 Page Per Minute (PPM) and the nip pressure was set to 2 $kgf/cm^2$. As shown in FIG. 11, when the complex viscosity was $1\times10^2$ to $1\times10^4$ Pa·S and the surface free energy of the contact surface 61Aa was approximately 5 $mJ/m^2$ or more and 30 $mJ/m^2$ or less, the occurrence of the toner offset could be suppressed.

It should be understood that although various examples have been described and shown herein, other examples can be modified in their arrangement and details.

For example, in the gloss treatment device 60, the discharging device 67 may be omitted. In this case, the paper 3 may be more easily peeled off from the endless belt 61 by setting a large curvature of the tension roller 64. Additionally, in the gloss treatment device 60A, the second endless belt 61B may have a contact surface having a surface free energy of approximately 5 $mJ/m^2$ or more and 30 $mJ/m^2$ or less on the outer circumference. At least one of the first endless belt 61A and the second endless belt 61B may form a contact surface having a surface free energy of approximately 30 $mJ/m^2$ or less. In addition, the gloss treatment devices 60 and 60A may be applied to an imaging device without any fixing device 50.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

The invention claimed is:

1. A gloss treatment device comprising:

an endless belt to convey a print medium in a conveyance direction;

a heating roller to heat the print medium;

a pressing roper to press the print medium and the endless belt against the heating roller at a nip position; and a charging device located upstream the nip position in the conveyance direction, to charge the print medium with an electrostatic charge.

2. The gloss treatment device according to claim 1, comprising:

a discharging device located downstream the nip position in the conveyance direction, to remove the electrostatic charge from the print medium.

3. The gloss treatment device according to claim 2, the heating roller to heat the print medium so that a temperature of the print medium is approximately 105° C. or less when the print medium reaches the discharging device during a gloss treatment process.

4. The gloss treatment device according to claim 1, wherein the charging device includes a charging roller and a grounding roller that nip the endless belt between the charging roller and the grounding roller.

5. The gloss treatment device according to claim 1, comprising:

a tension roller disposed downstream the nip position in the conveyance direction, to engage the endless belt.

6. The gloss treatment device according to claim 1, wherein the endless belt has a surface free energy of approximately 5 $mJ/m^2$ or more.

7. The gloss treatment device according to claim 1, the heating roller to set a temperature of the print medium to approximately 85° C. to 150° C. at the nip position.

8. An imaging device comprising the gloss treatment device according to claim 1, and a fixing device to fix a toner image on the print medium, wherein the print medium on which a toner image is fixed is provided to the gloss treatment device.

* * * * *